US005444878A

United States Patent [19]

Kang

[11] Patent Number: 5,444,878

[45] Date of Patent: Aug. 29, 1995

[54] HEAT PRODUCING MATTRESS FILLED WITH HARDENED MUD

[76] Inventor: Moo W. Kang, 17532 Vierra Ave., Cerritos, Calif. 90703

[21] Appl. No.: 294,589

[22] Filed: Aug. 23, 1994

[51] Int. Cl.[6] ..... A47C 21/04

[52] U.S. Cl. ..... 5/421

[58] Field of Search ..... 5/450, 422, 909, 421, 5/448

[56] References Cited

U.S. PATENT DOCUMENTS

| | | | |
|---|---|---|---|
| 3,787,908 | 1/1974 | Beck et al. | 5/450 |
| 3,810,265 | 5/1974 | McGrew | 5/909 |
| 4,068,335 | 1/1978 | Phillips | 5/450 |
| 4,255,824 | 3/1981 | Pertchik | 5/450 |
| 5,179,742 | 1/1993 | Oberle . | |

FOREIGN PATENT DOCUMENTS

| | | | |
|---|---|---|---|
| 2161704 | 1/1986 | United Kingdom | 5/909 |

*Primary Examiner*—Michael J. Milano

[57] ABSTRACT

A thermal mattress filled with hardened mud which houses electrical wires intended to provide warmth, restore health, assist in blood circulation, and repair body cells for the user. The mud mattress comprises several different layers to assist in preventing humidity and transferring of heat. An automatic thermostatic controller easily adjusts the heating temperature and prevents over-heating.

1 Claim, 3 Drawing Sheets

HEAT PRODUCING MATTRESS FILLED WITH HARDENED MUD

FIELD OF THE INVENTION

This invention relates to a bed mattress, particularly to a mattress which is filled with hardened mud and utilizes heat producing wires located within the bed to emit nucleus external rays.

BACKGROUND OF THE INVENTION

Bed mattresses that are utilized today provide cushion and comfort during sleep or rest. These mattresses do not provide any additional functions except reclining options. A few mattresses exist which are therapeutic in nature. For example, a mattress on the market which reduces pressure by use of a resilient material as a top layer, disclosed in U.S. Pat. No. 5,179,742 issued Jan. 19, 1993. This mattress, however, does not provide any heat for the user.

There are individuals who suffer from various illnesses and are in need of warmth and comfort for extended hours while they are bedridden. It is very important for individuals who suffer from these illnesses to remain at a particular body temperature. A heating unit in a home may not be able to provide adequate heat for the individual.

Furthermore, the cost of heating an entire house during the winter season or summer evenings can be very expensive and thick blankets are often insufficient.

There is a well known soil in Korea which, when subjected to a heating process emits nucleus external rays. This external ray is popular for treating infectious germs, preventing breast cancer, increasing one's blood flow and repairing body cells.

Accordingly, one object of the present invention is to provide a mattress that produces heat and assists in the restoration of good health in a cost-efficient manner.

A further object of the present invention is to provide a mattress in which the components of the mattress will have a relatively long useful life.

It is another object of the present invention to provide a mattress which is safe to use.

SUMMARY OF THE INVENTION

The present invention incorporates heat producing wires within a mattress which is composed of natural soil. When an electrical current is applied within the bed unit, heat is generated by the installed wires.

The mud mattress has an automatic thermostatic temperature controller for easy heating adjustment. The mud mattress has a top layer which is made of hardened mud consisting of natural vegetation, flower chromosomes, cork and pine tree powder. The second layer of the mattress is made of soil consisting of white mud, yellow mud, red clay, powder, and silica. The third layer is made of grass consisting of mugwort, sea grass, yellow stalk, and Chinese herb grass.

The fourth layer of the mattress is a heat transferring net. The next plate consists of OPP synthetic skin, aluminum coating, calbanium, a heat elevation prevention device, a heat sensing device, a heat producing silicon layer, an aluminum sealing tape, a Urethane layer, and an anti-humidity craft paper.

The third plate is a copper plate which prevents water force from occurring. The outer shell contains an outer shell which contains a wood frame, wood beam, cushion material, outer skin made of leather or silk, and gold plated ornaments for decorating purposes.

These together with other objects of the invention are pointed out clearly in the claims annexed to and forming a part of this disclosure. For a better understanding of the invention, its operating advantages and the specific objects attained by its use, reference should be made to the accompanying drawings and descriptive matter in which there are illustrated preferred embodiments of the invention.

BRIEF DESCRIPTION OF THE PREFERRED EMBODIMENT

For a better understanding of the nature of the present invention, reference should be made to the following detailed description taken in connection with the accompanying drawings in which.

DETAILED DESCRIPTION OF THE PREFERRED EMBODIMENT

Figure 1:
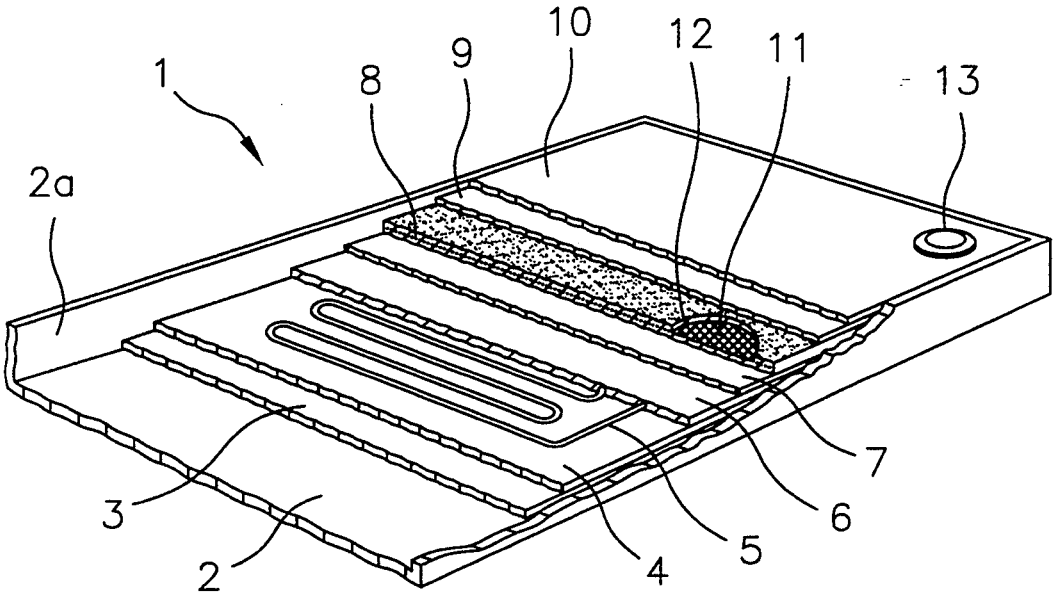
FIG. 1 is a view of the thermal mud mat showing the interior elements.
Figure 2:
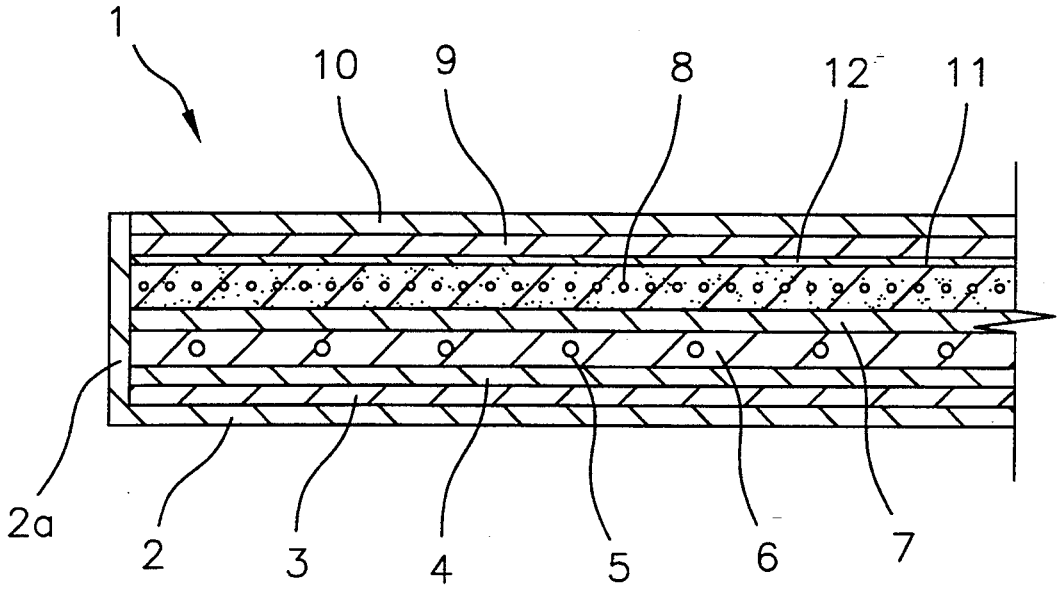
FIG. 2 is a sectional view of the thermal mud mattress.
Figure 3:
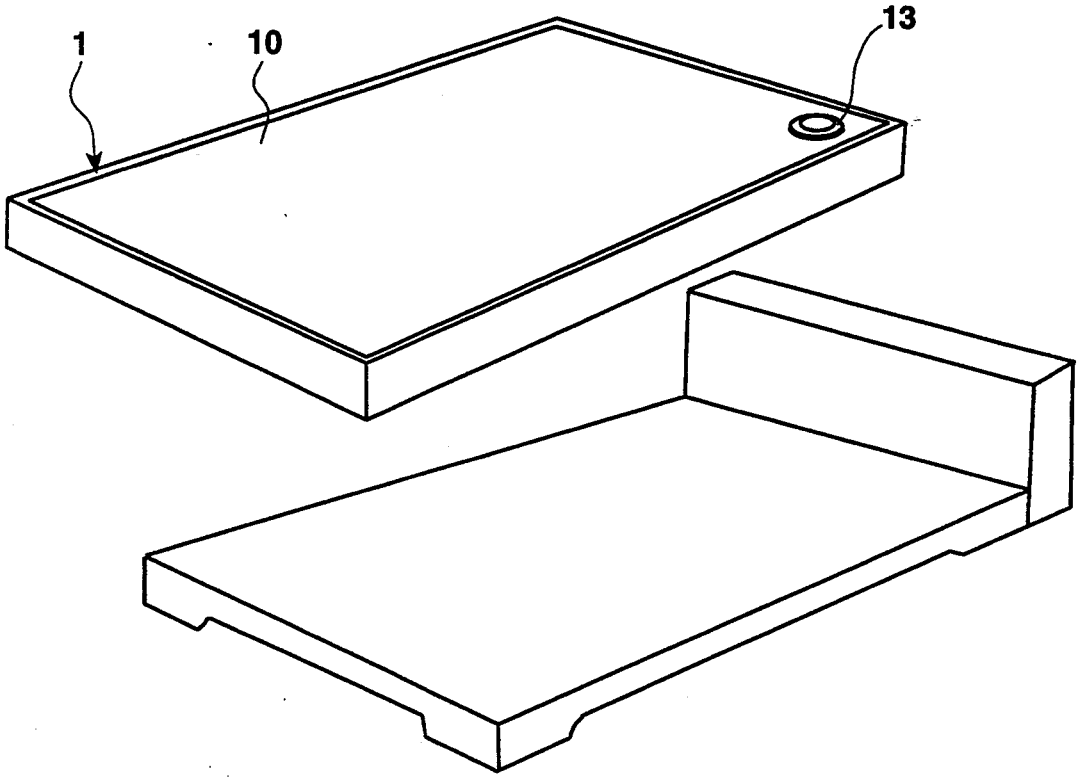
FIG. 3 is a perspective view of the thermal mud mattress.

As shown in FIGS. 1–3, the present invention is a thermal mattress filled with mud.

Referring now to FIG. 1, a view of the thermal mud mattress showing the interior elements. The bed mattress 1 is comprised of a lower plate 2, a side wall 2*a*, an initial layer 3, a secondary layer 4, a heat producing pipe line 5, a plate housing said heat producing pipe line 6, a copper plate 7, a mud plate 8, rice paper 9, cover sheet 10, heat transferring net 11, a nucleus external ray dispensing layer 12, and an automatic heat control unit 13.

FIG. 2 is a sectional view of the thermal mud mattress 1 showing how the heat producing pipe line 5 is able to emit heat through the copper plate 7 and allow the user to absorb the nucleus external rays.

FIG. 3 is a perspective view of the thermal mud mattress accentuating the cover sheet 10 and the automatic heat control unit 13. The heat is applied to the primary areas of one's body (upper back, lower back, etc.) to provide treatment of tension. The heat relaxes the user and assists in the circulation of blood.

I claim:

1. A heat producing mattress filled with hardened mud comprising:

a lower plate;

a side wall perpendicular to said lower plate;

an initial layer of said lower plate;

a heat producing pipe line attached on top of said initial layer;

a plate housing said heat producing pipe line consisting of OPP synthetic skin, aluminum coating, calbanium, a heat elevation prevention device, a heat sensing device, a heat producing silicon layer, an aluminum sealing tape, a Urethane layer, and an anti-humidity craft paper;

a copper plate on top of said plate housing said heat producing pipe line;

a mud plate on top of said copper plate consisting of natural vegetation, flower chromosomes, cork, pine tree powder, soil consisting of white mud, yellow mud, red clay, powder, silica, grass, mugwort, sea grass, yellow stalk, and Chinese herb grass;

a heat transferring net on said mud plate;

a nucleus external ray dispensing layer on said heat transferring net;

rice paper on top of said nucleus external ray dispensing layer;

a cover sheet on top of said rice paper;

an automatic heat control unit on top of said cover sheet.

* * * * *